US008669196B2

(12) United States Patent
Mehta et al.

(10) Patent No.: US 8,669,196 B2
(45) Date of Patent: Mar. 11, 2014

(54) ROOFING MEMBRANES

(75) Inventors: Naresh R. Mehta, Cranston, RI (US); Jeffrey Charles Flath, Warwick, RI (US); David Allen Pettey, Westport, MA (US)

(73) Assignee: Cooley Group Holdings, Inc., Pawtucket, RI (US)

( * ) Notice: Subject to any disclaimer, the term of this patent is extended or adjusted under 35 U.S.C. 154(b) by 827 days.

(21) Appl. No.: 12/126,256

(22) Filed: May 23, 2008

(65) Prior Publication Data

US 2009/0291249 A1 Nov. 26, 2009

(51) Int. Cl.

| | |
|---|---|
| ***D04H 1/46*** | (2012.01) |
| ***B32B 27/30*** | (2006.01) |
| ***B32B 17/12*** | (2006.01) |
| ***B32B 5/26*** | (2006.01) |
| ***D06N 7/00*** | (2006.01) |
| ***B32B 37/00*** | (2006.01) |

(52) U.S. Cl.
USPC ..... 442/402; 442/26; 442/27; 442/35; 442/45; 442/396; 156/60; 156/157; 156/166; 156/176; 428/141; 428/332; 28/107

(58) Field of Classification Search
USPC ..... 442/37–49, 59–180, 394–399, 402
See application file for complete search history.

(56) References Cited

U.S. PATENT DOCUMENTS

| | | | | |
|---|---|---|---|---|
| 3,695,962 | A | 3/1970 | Oosterlynck | |
| 4,301,204 | A * | 11/1981 | McCusker et al. | 428/110 |
| 4,390,585 | A | 6/1983 | Holden | |
| 4,458,043 | A | 7/1984 | Evans et al. | |
| 4,468,422 | A | 8/1984 | Siener, Jr. et al. | |
| 4,696,847 | A * | 9/1987 | Cousin et al. | 428/76 |
| 4,804,572 | A | 2/1989 | Bodrogi | |
| 5,108,831 | A * | 4/1992 | Green | 442/24 |
| 5,271,992 | A | 12/1993 | Siener, Jr. et al. | |
| 5,529,835 | A | 6/1996 | Siener, Jr. et al. | |
| 5,620,554 | A | 4/1997 | Venable | |

(Continued)

FOREIGN PATENT DOCUMENTS

| | | |
|---|---|---|
| CA | 2 522 503 A1 | 4/2007 |
| EP | 1225265 A1 | 7/2002 |

(Continued)

OTHER PUBLICATIONS

Textile Glossary definitions of nonwoven, felt, fleece published by Celenese Acetate, 2001.*

(Continued)

*Primary Examiner* — Jennifer A Steele
(74) *Attorney, Agent, or Firm* — Lando & Anastasi, LLP

(57) ABSTRACT

An impact resistant membrane and methods of preparing and utilizing the membrane are disclosed. The membrane comprises a loft layer, a first polymeric layer bonded to a first surface of the loft layer, and a second polymeric layer bonded to a second surface of the loft layer. The membrane can be fabricated by providing a loft layer and applying a polymeric layer on a first surface and on a second surface of the loft layer. The membrane has a higher resistance to failure due to impact and thus protects the underlying structure membrane for a longer time. A method of facilitating protecting a structure comprises providing a single ply membrane having a loft layer and a polymeric layer disposed on at least two surfaces of the loft layer.

9 Claims, 5 Drawing Sheets

(56) References Cited

U.S. PATENT DOCUMENTS

| | | | | |
|---|---|---|---|---|
| 5,655,324 | A | 8/1997 | Siener, Jr. et al. | |
| 5,827,787 | A | 10/1998 | White | |
| 6,355,329 | B1 | 3/2002 | Rose et al. | |
| 6,822,024 | B1 | 11/2004 | Spirkowyc et al. | |
| 7,169,719 | B2 | 1/2007 | Mehta et al. | |
| 2002/0127933 | A1* | 9/2002 | Baccus et al. | 442/86 |
| 2005/0210808 | A1 | 9/2005 | Larson et al. | |
| 2005/0282449 | A1* | 12/2005 | Mehta et al. | 442/35 |
| 2007/0117487 | A1 | 5/2007 | Whitehead et al. | |

FOREIGN PATENT DOCUMENTS

| | | | |
|---|---|---|---|
| JP | 2006-104658 | | 4/2006 |
| JP | 2006-112031 | A | 4/2006 |
| KR | 20-0434864 | | 12/2006 |

OTHER PUBLICATIONS

International Search Report from corresponding International Application No. PCT/US2009/044992, dated Dec. 28, 2009.

* cited by examiner

ROOFING MEMBRANES

BACKGROUND OF THE DISCLOSURE

1. Field of the Disclosure

The present disclosure relates to roofing membranes, and more particularly to roofing membranes having a loft or resilient layer.

2. Discussion of Related Art

Roofing membranes were typically comprised of a scrim impregnated with a bituminous asphaltic or rubber based compounds. One side of the membrane was coated with a mineral filler, such as sand, talc, or fine gravel. U.S. Pat. No. 4,458,043 describes particulate fillers as reinforcing fillers, such as carbon black, silica, zinc oxide, phenolic resin and magnesium carbonate, and non-reinforcing fillers such as calcium carbonate (whiting), barium sulphate, hydrated aluminum silicate, china clay, and magnesium silicate.

To solve the adhesion problem with vulcanized EPDM (Ethylene-Propylene-Diene Monomer) rubber, roofing membranes can utilize a backing layer laminated to the EPDM rubber. An exemplary product and method of manufacture thereof was described in U.S. Pat. No. 5,620,554.

Lin-Luc Jacques Servais Oosterlynck disclosed a method of making pile fabrics in U.S. Pat. No. 3,695,962, wherein a fibrous layer is needle punched through a support fabric, and the needle-punched fibers form tufts extending from the support fabric. Backside needling techniques facilitated control of the height of the pile.

A fleece-backed laminate with a needle punched fleece formed on both sides of a thermoplastic reinforced planar sheet was disclosed in U.S. Pat. No. 7,169,719.

SUMMARY OF THE DISCLOSURE

One or more aspects of the disclosure relate to a membrane comprising a loft layer having a first surface and a second surface, a first polymeric layer bonded to the first surface of the loft layer, and a second polymeric layer bonded to the second surface of the loft layer. The loft layer can comprise a random arrangement of fibers. The membrane loft layer can comprise a reinforcing substrate. The reinforcing substrate can also be needle-punched with a fleece. The membrane fleece can comprise synthetic fibers. The first polymeric layer can comprise a thermoplastic material selected from the group consisting of polyolefin, polyvinyl chloride, polypropylene, polyethylene, rubber.

Some aspects of the disclosure relate to a method of fabricating a membrane. The method can comprise providing a loft layer, and applying a polymeric layer on a first surface and on a second surface of the loft layer. The method can further comprise reinforcing the loft layer prior to applying the polymeric layer around the loft layer. In the method, reinforcing the loft layer can comprise interconnecting the loft layer with a reinforcing fabric. The method can, in some cases provide an extrusion coating with the polymeric layer. The method can comprise applying a second polymeric layer on a second surface of the loft layer.

Further aspects of the disclosure relate to a method of facilitating protecting a structure. The method of facilitating protection can comprise providing a single ply membrane having a loft layer and a polymeric layer disposed on at least two surfaces of the loft layer. The method can comprise installing the single ply membrane on at least a portion of a roof of the structure.

BRIEF DESCRIPTION OF THE DRAWINGS

The accompanying drawings are not intended to be drawn to scale. In the drawings, each identical or nearly identical component that is illustrated in various figures is represented by a like numeral. For purposes of clarity, not every component may be labeled in every drawing.

In the drawings.

DETAILED DESCRIPTION

Figure 1:
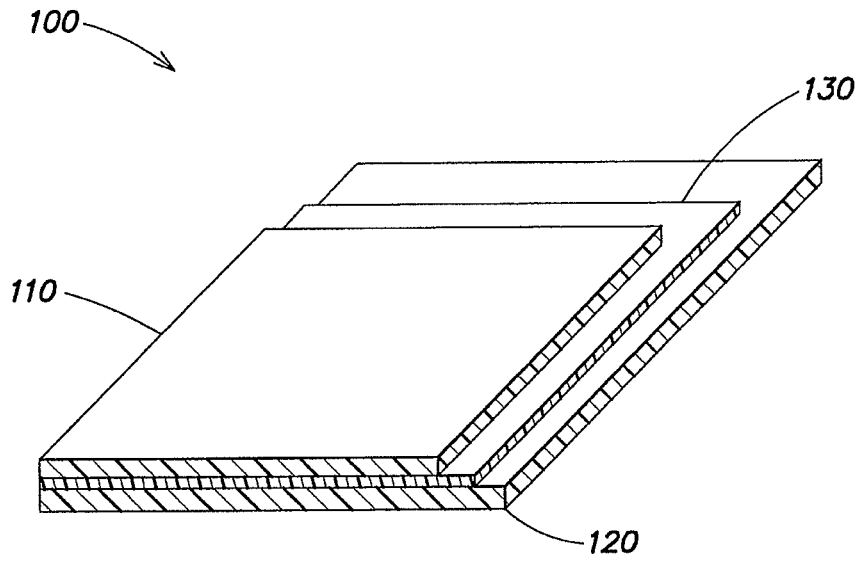
FIG. 1 is a schematic representation of an embodiment showing an exploded view of a membrane with two polymeric layers and a loft layer, in accordance with some aspects of the disclosure.

The disclosed features and aspects herein are not limited to the details of construction and the arrangement of components set forth in the following description or illustrated in the drawings. One or more aspects of the present disclosure is capable of other embodiments and of being practiced or of being carried out in ways other than in the manner explicitly described herein.

One or more aspects of the disclosure pertain to a membrane comprising, consisting of, or in some cases, consisting essentially of a loft layer, a first polymeric substrate disposed against a first surface of the loft layer, and a second polymeric substrate disposed against another surface of the loft layer. The membrane, in some cases, comprises, consists of, or consists essentially of a first surface and a second surface, a first polymeric layer bonded to the first surface of the loft layer, and a second polymeric layer bonded to the second surface of the loft layer.

Other aspects of the disclosure relate to a method of fabricating a membrane comprising providing a loft layer, and applying a polymeric layer on a first surface and on a second surface of the loft layer.

Still further aspects of the disclosure relate to a method of protecting a structure comprising providing a single ply membrane having a loft layer and a polymeric layer disposed on at least two surfaces of the loft layer.

FIG. 1 exemplarily illustrates an embodiment pertinent to one or more aspects disclosed herein. In the schematic illustration presented in FIG. 1, a membrane generally indicated at 100 can comprise a first polymeric layer 110 and, optionally, a second polymeric layer 120. In one embodiment, membrane 100 preferably comprises at least one loft layer 130 disposed proximate at least one of first and second layers 110, 120, and preferably, between the first and second layers. If a surface of first polymeric layer 110 is directly in contact with a first surface of loft layer 130, as shown, the contacting surfaces are preferably bonded or at least a portion thereof are secured together. If a surface of second polymeric layer 120 is in contact with a surface of loft layer 130, as shown, the contacting surfaces are preferably bonded or at least a portion thereof are secured together.

Any of the first and second polymeric layers, or at least portions thereof, can comprise a thermosetting polymeric material. In some cases, however, at least a portion of any of the first polymeric layer and the second polymeric can comprise a thermoplastic polymeric material. Preferred embodiments, however, typically involve at least one thermoplastic polymeric layer. The thermoplastic material can be based on, for example, an extrudable or moldable polymer. Advantageous embodiments can comprise compounded materials based on at least one polymeric matrix. The polymeric matrix, for example, can comprise, consist of, or consist essentially of any of polystyrene, polypropylene, polybutylene, polyethylene, poly(vinyl chloride), poly(vinyl fluoride), poly(vinylidene fluoride), polycarbonate, polyimide, polyamide, polyisoprene, styrene butadiene copolymer, polybutadiene, ethylene propylene copolymer, polyisobutylene, halogenated polyisobutylene such as chlorobutyl and bromobutyl variants, polyacrylate, polyacrylonitrile, polychloroprene, chlorosulfonated polyethylene, polyurethane, polysiloxane, polysulfide, polychlorotrifluoro ethylene, vinylidene fluoride, hexafluoropropylene, polyester polyether copolymer, styrenated aliphatic copolymer, ethylene acrylate copolymer or ethylene interpolymeric alloys and derivatives thereof such as those commercially available as ELVALOY® from E.I du Pont de Nemours and Company, Wilmington, Del., and blends or mixtures thereof.

In other embodiments, the membrane can comprise a loft or random fiber layer, without or partially reinforced, encapsulated by roofing material. The roofing material can comprise or consist essentially of any of modified elastomeric polyolefin and modified bitumen, alone or as composites, blends, or mixtures with any of the noted polymeric materials.

In advantageous embodiments, any of the membranes can comprise a polymeric layer comprising a polymeric matrix compounded to have desirable characteristics. For example, any of the polymeric layers or at least a portion thereof can comprise polyvinyl chloride compounded with agents that provide weather resistance and, in some cases, flame or fire resistance. In still other advantageous embodiments, at least one polymeric layer or at least a portion thereof can comprise other agents that improve mechanical properties thereof such as, but not limited to, creep resistance, tear resistance, tensile strength, elasticity or strain, hardness, glass transition temperature and impact resistance. For example, the polymeric matrix of the polymeric layer can comprise at least one reinforcing agent such as but not limited to carbon black, silica, and blends or variant grades thereof. In yet other embodiments, any of the polymeric layers can comprise a material compounded with at least one pigment, at least one plasticizer or processing aid, and combinations thereof. In still other cases, the polymeric matrix can incorporate one or more components that modify the resultant density of the layer. For example, blowing agents or hollow beads can be incorporated into the polymeric matrix that decreases the specific gravity of the resultant polymeric layer. Still other additives that can be utilized include, but are not limited to those that modify the electrical properties of the polymeric layer. For example, conductive agents can be compounded into the polymeric matrix that increases the electrical conductivity thereof.

The amount or type or both of each or any of the compounding components of the polymeric layer can vary to provide any of desirable characteristic. For example, a phthalate plasticizer can be compounded into a polyvinyl chloride-based polymeric layer in any amount ranging from about 1 part to 70 parts per 100 parts polymeric matrix. Likewise, titanium dioxide pigment can be utilized in any amount ranging from at least about 0.5 parts per 100 parts polymeric matrix. Other notable compounds or formulations may be utilized to tailor any of the chemical and mechanical properties of the polymeric layer.

First polymeric layer 110 can comprise the same type of compounded polymeric material. In some embodiments, however, the membrane can have advantageously utilize different polymeric layers. For example, first polymeric layer can comprise a first polymeric material compounded to be weather resistance by incorporating therein one or more light stabilizing agents, anti-oxidant or anti-ozonant agents; and second polymeric layer can comprise a second polymeric matrix compounded to have a tear resistance greater than the first polymeric layer. Indeed, other embodiments can utilize one or more other polymeric layers any one or more of which can be disposed against any of the first and second layers and even between the first and second layers. The amount of any of the antioxidants, antiozonants, light stabilizing agents, and process lubricants can be from about 0.1 parts to about 10 parts per 100 parts polymeric matrix.

The first polymeric layer 110 and the second polymeric layer 120 can be disposed on loft layer 130 using any suitable technique. For example, any of the first and second layers can be disposed against at least a portion of the loft layer by extrusion coating techniques. Other techniques that may be utilized include calendering any of the first and second layers on the loft layer. Likewise, where any further polymeric layers are utilized, any technique may be utilized to prepare a compound or multi-layered polymeric layer. Other techniques include, for example, air knife coating, immersion or dip coating, gap coating, curtain coating, rotary screen coating, reverse roll coating, gravure coating, metering rod (Meyer bar) coating, slot die (Extrusion) coating, hot melt coating, roller coating, and flexographic coating.

Particularly advantageous aspects of the present disclosure involve a loft layer 130 that increases a thickness or bulk of membrane 100. Preferably, however, other properties or characteristics remain unchanged or comparable to membranes without such loft layers. For example, membrane 100 can have substantially the weight or density, within about 10% or even within about 5%, relative to the membranes without the one or more loft layers 130.

Loft layer 130 may, in some configurations, protect the first or second polymeric layers 110, 120, respectively, from abrasion caused by a roof deck structure or debris on a roof deck structure, depending on where and in what direction the membrane is installed. Loft layer 130 additionally may protect any of the first or second polymeric layers 110, 120 from abrasion caused by adverse weather conditions such as, but not limited to, rain, snow, sleet, and hail. Loft layer 130 may, in other configurations, also have decreased thermal conductivity, acoustical transmittance therethrough, or both, relative to membranes without such features. The inclusion of the at least one loft layer 130 in membrane 100 is particularly advantageous in roofing applications, as compared to foams, for example, due to its puncture resistance, thermal stability and solvent resistance. Loft layer 130 can also provide improved physical properties such as an increase in the amount of impact energy that the membrane can absorb, thus increasing its overall impact and weather resistance.

Figure 2:
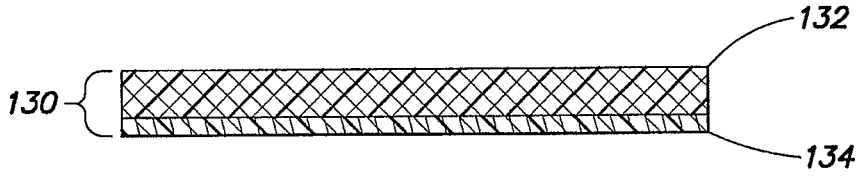
FIG. 2 is a schematic representation of a loft layer with a reinforcing substrate in accordance with some aspects of the disclosure.

In some cases, loft layer 130 can comprise a multi-layered arrangement including one or more randomly arranged matrix of fibers in a cushioning substrate 132 and one or more layers of reinforcing substrate 134, as illustrated in FIG. 2. At least a portion of substrate 132 is typically secured or attached to reinforcing substrate 134 by suitable techniques. For example, substrate 132 can be needle-punched on substrate 134 or be adhesively secured thereto. Other configurations, however, can involve securing substrates 134 with heat or ultraviolet activated coatings that have functional groups that can react, e.g., crosslink, with moieties that are on or part of substrate 132. For example, substrate 134 can have a coating with polyisocyanurate functional groups and substrate 132 can comprise a matrix with hydroxyl functional groups or a coating with functional groups that can react with the polyisocyanurate moieties. Linkages can be formed between the reactive functional moieties by curing, which can involve free radical reaction mechanisms. Other non-limiting examples of reactive schemes can include coatings or reactive pairings that form amide linkages or even vinyl precursor linkages.

Randomly arranged layer of fibers 132 can create a surface that is adhered, and also adds dimensional strength. Fibers 132, in this context, can comprise a fuzzy scrim, felt or non-woven. Fibers 132 may be comprised of synthetic or natural fibers, yarn, or battings and sometimes referred to as "fleece." Fibers 132 can comprise polyesters, nylons, polypropylenes, polyamides, polyimides, polyethylenes, cellulosic materials, glasses, polyacrylics, polycarbonates, polyacetals and ketals, polyurethanes, copolymers and terpolymers, or blends thereof. In other cases, the fibers can comprise inorganic components, such as but not limited to fiberglass or other mineral-based materials. Fibers 132 are preferably polyester or similar polymeric material that has suitable weather resistance, strength, availability and cost for, for example, roofing applications. Thus, the fiber of the loft layer can be any suitable natural or synthetic fibers that alter the overall density of the membrane without adversely affecting the physical properties thereof.

The at least one reinforcing substrate 134 can be a knit, woven, or cross-laid fabric. Reinforcing substrate 134 is preferably a polyester scrim. In one embodiment, reinforcing substrate 134 may be needle-punched with fibers 132. By adding reinforcing substrate 134 as a component of loft layer 130, membrane 100 can be rendered substantially reinforced.

Composite loft layer 130 is thus typically thicker than the standard practice of using scrim or fabric alone, thereby reducing the amount of polymeric compound needed to achieve the desired thickness of membrane 100. The substrate offers mechanical bonding to the extruded compound resulting in superior adhesion of the compound to the substrate. The fleece in the substrate typically increases the resistance to impact, making the product superior in resisting damage due to impact.

Additional considerations in selection and preparation of loft layer 130 can include maximizing the tensile strength, increasing tear resistance, minimizing bulk, and maximizing impact resistance.

Referring to FIG. 2, reinforcing substrate 134 in a preferred embodiment has any of a 7 to 24 by 7 to 24 count of 50 to about 2,000 denier threads. A preferred reinforcing substrate has a 9×9 count of about 1,000 denier threads. First polymeric layer 110 and the second polymeric layer 120 are preferably extrusion coated with 5-100 mils thick compounded PVC in a first pass. In a second pass, an additional 5-100 mils thick compounded PVC is coated onto the opposite side. The composition of the compounded PVC substrate is, by weight percent, from about 40% to about 60% PVC, from about 7% to about 40% plasticizer, and the balance can be any of fillers, colorants, flame retardants, stabilizers, and lubrication processing aides.

When forming the polymeric layers, stress relieving techniques may be utilized. For example, the composite single ply membrane may be annealed at temperatures approaching the melting point of the polymeric materials of the membrane.

The thermoplastic coating and composite loft or substrate can be nip squeezed between a rubber roll and steel roll to promote adhesion of the thermoplastic coating to the loft layer or substrate. The substrate may be preheated prior to coating. The thermoplastic coating may then be extruded from the die onto the scrim at the nip point of a steel roll and a rubber roll. The nip then forces the thermoplastic coating against the substrate on one side, and the steel roll cools and smoothes the thermoplastic coating. The process for making the polymeric layers is usually run in two passes. It is possible, however, to form the membrane in one pass by applying both the face and the back material to the fabric at the same time or by laminating a film to the scrim using an adhesive layer applied by extrusion or liquid coating methods. However, other techniques may be utilized to fabricate the membrane.

Furthermore, it is recognized that there may be many sources for suitable polymeric layers. While a method has been given for its production, the disclosed product and method does not turn on the exclusive utilization of any particular thermoplastics.

The composition of the thermoplastic material may be weather resistant, mold resistant, fungi resistant, flame resistant (according to NFPA 701 vertical burn or ASTM E-108) and pass the requirements of the CSFM (California State Fire Marshall).

In a preferred embodiment, the thickness of the extruded polymeric compound ranges from 5 mils to 100 mils. In a preferred embodiment, the weight of the scrim or fabric range from 0.5 oz. to 20 oz. per square yard. In a preferred embodiment, the weight of the fleece range from 0.5 oz. to 20 oz. per square yard. Also, in a preferred embodiment, the range of polymers that can be used include olefins, PVC, TPO, EVA, EMA, EBA, Elvaloy®, PVC/Elvaloy®, PVC/Urethane, PVB, Polyamide, TPU, PVC/Nitrile, ABS, PVDF, PET, PBT, polycarbonate, acrylics and mixtures, copolymers, or blends thereof.

The membrane is typically provided to installers who lay the membrane on a roof of the structure or lay on the ground as a geomembrane liner. The roofing membrane or geomembrane can either be mechanically attached or fully adhered to the roof deck.

The function and advantages of these and other embodiments of the present disclosure can be further understood from the examples below, which illustrate the benefits and/or advantages thereof but do not exemplify the full scope of the disclosure.

EXAMPLES

In Examples 2-5, falling weight impact test (DYNATUP) were performed on conventional laminate membranes and on membranes in accordance with some aspect of the present disclosure.

An INSTRON DYNATUP impulse data acquisition system was utilized with a tup diameter of 12.7 mm in accordance with ASTM D 3763, test speed of 3.3 meters per second.

The dimensions of each of the specimens were 102 mm×102 mm with the respective indicated thickness. Polyester fibers were used in each of the specimens. Each specimen was mounted on a 2 inch square polyisocyanurate foam.

Each membrane specimen in Examples 2-5 was fabricated in a similar manner. A 9 count×9 count polyester knit scrim was needle-punched with 5 oz of polyester fiber. Rolls of the needle-punched fleece substrate were mounted on the extruder, unwound and fed into the calendar nip rolls. A PVC or TPO compound was extruded into the nip onto the substrate to coat one side of the fleece. The other side of the fleece was extrusion coated in a similar manner with either PVC or TPO compound. The edges of the substrate were encapsulated by extruding in a wider width then the width of the substrate. Excess width was trimmed off the edges and the finished roofing membrane was rolled up in customer specified lengths.

The PVC and TPO compounds utilized were designed for roofing applications. The PVC compounds used in preparing the PVC-based specimens utilized C3 face and C3 back compounds, available from Cooley, Incorporated, Pawtucket, R.I. The TPO compounds used in preparing the TPO-based specimens utilized CSP-TPO-face and CSP-TPO-back compounds, which were prepared at the extruder, also available from Cooley, Incorporated.

Example 1

Tables 1 and 2 provide exemplary formulations that can be used as polymeric layers in membranes in accordance with some aspects of the invention. In Tables 1 and 2, reference to "face" and to "back" typically indicate the top and bottom layers of the membrane, respectively.

TABLE 1

Typical PVC-based formulation.

| Ingredient | Face % | Back % |
|---|---|---|
| PVC | 51.00 | 53.00 |
| $TiO_2$ | 6.00 | 0.00 |
| Gray pigment concentrate | 0.00 | 0.50 |
| Calcium Carbonate | 3.00 | 9.00 |
| Phthalate Plasticizer | 30.00 | 29.00 |
| Epoxidized Soybean Oil | 2.00 | 2.00 |
| Oxybisphenoxyarsine (OBPA) concentrate with 10% active ingredient | 1.00 | 1.00 |
| Antioxidant IRGANOX 1076 | 0.30 | 0.30 |
| Hindered Amine Light Stabilizing Agent (HALS) TINUVIN 622 LD | 0.20 | 0.00 |
| Antimony Oxide | 3.00 | 2.00 |
| Ba—Zn Stabilizer | 3.00 | 2.60 |
| Process lubricant Oxidized polyethylene | 0.50 | 0.60 |
| Total | 100.00 | 100.00 |

TABLE 2

Typical TPO-based formulation.

| Ingredient | Face % | Back % |
|---|---|---|
| TPO | 60.00 | 69.10 |
| $TiO_2$ | 6.00 | 0.00 |
| Calcium Carbonate | 2.20 | 10.00 |
| Gray Pigment Concentrate | 0.00 | 0.00 |
| Magnesium Hydroxide | 27.00 | 20.00 |
| UV Stabilizer | 1.00 | 0.00 |
| Oxybisphenoxyarsine (OBPA) concentrate with 10% active ingredient | 1.00 | 0.00 |
| Antioxidant IRGANOX 1076 | 0.30 | 0.30 |
| Hindered Amine Light Stabilizer Agent (HALS) TINUVIN 622 LD | 2.00 | 0.00 |
| Process Lubricant Oxidized polyethylene | 0.50 | 0.60 |
| Total | 100.00 | 100.00 |

Example 2

A conventional PVC-based membrane was prepared by laminating PVC on a scrim having an average thickness of 38.9 mm. Impact testing was performed on five specimens, and the results are presented in Table 3 and FIG. 3.

Figure 3:
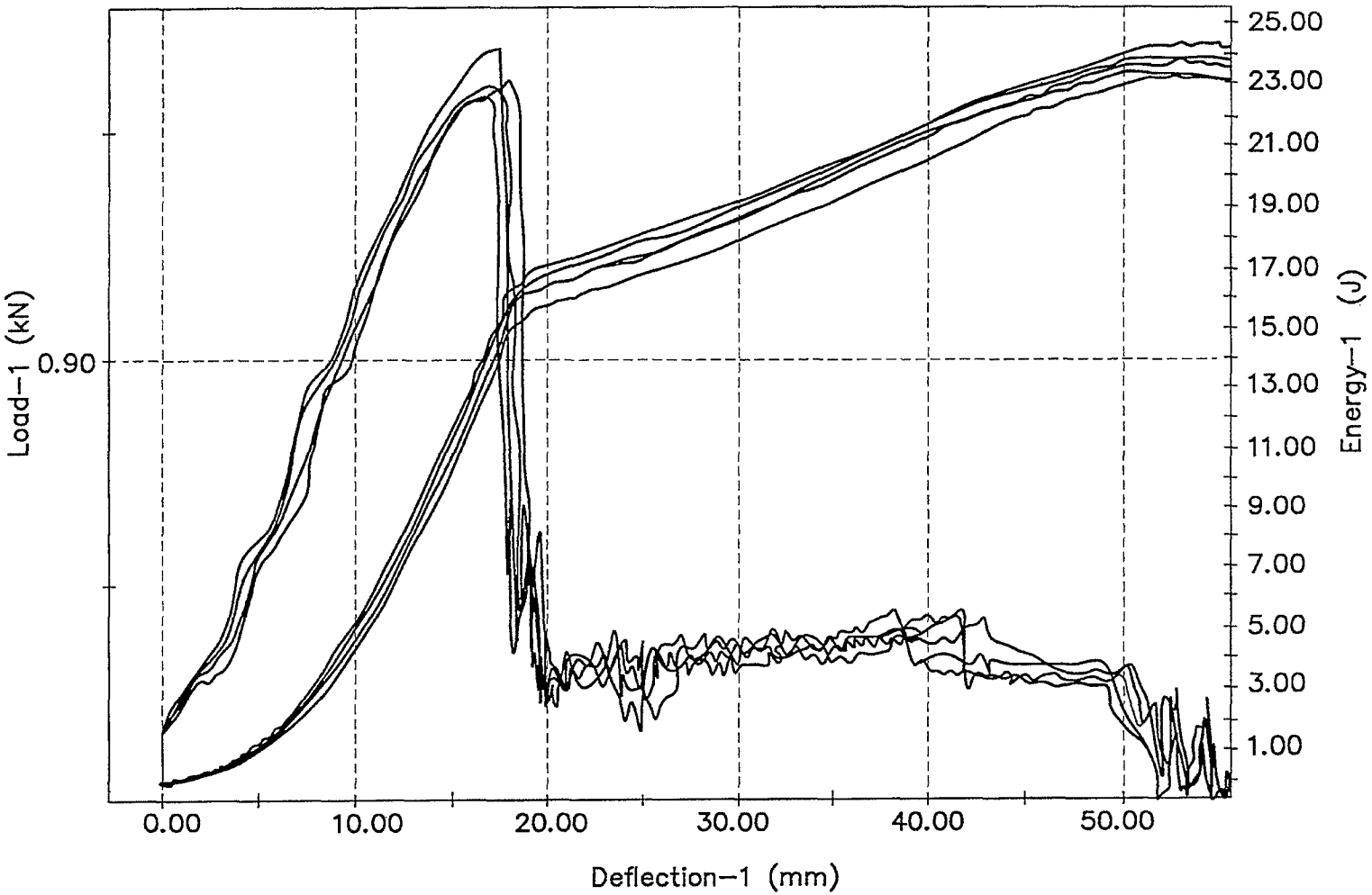
FIG. 3 is a graph showing the results of Example 2.

FIG. 3 shows the measured load relative to the deflection during the DYNATUP impact test for each of the five specimens. FIG. 3 shows the relatively low level of resistance to impact where the deflection occurs, at between 16.95 mm and 18.19 mm in each run.

TABLE 3

| Test No. | Impact Velocity (m/s) | Thickness (mm) | Deflection at Max Load (mm) | Max Load (N) | Energy to Max Load (J) | Total Energy (J) | Time to Max Load (ms) |
|---|---|---|---|---|---|---|---|
| 1 | 3.30 | 38.18 | 17.34 | 1494 | 14.68 | 23.35 | 5.26 |
| 2 | 3.30 | 39.72 | 18.19 | 1523 | 15.34 | 24.3 | 5.53 |
| 3 | 3.29 | 38.29 | 16.95 | 1515 | 14.38 | 23.7 | 5.15 |
| 4 | 3.30 | 39.23 | 17.78 | 1502 | 14.26 | 23.25 | 5.38 |
| 5 | 3.30 | 39.19 | 17.52 | 1602 | 15.09 | 23.9 | 5.32 |
| Average | 3.30 | 38.92 | 17.56 | 1527 | 14.75 | 23.70 | 5.33 |

The results summarized in Table 3 show that an average deflection at peak load was about 17.6 mm, an average peak load was about 1,530 Newtons, an average energy at peak load was about 14.8 Joules, and an average total energy was about 23.7 Joules for a conventional PVC-based membrane. The 0.5 inch diameter tup penetrated the samples.

Example 3

An encapsulated loft PVC (designated as REVOLUTION ROOFING MEMBRANE) in accordance with some aspects of the disclosure was evaluated. The loft-encapsulated membrane was a PVC-based membrane that was prepared by laminating PVC on a composite loft substrate having an average thickness of 38.4 mm. Impact testing was performed on five specimens and the results are graphically presented in FIG. 4 and summarized in Table 4.

Figure 4:
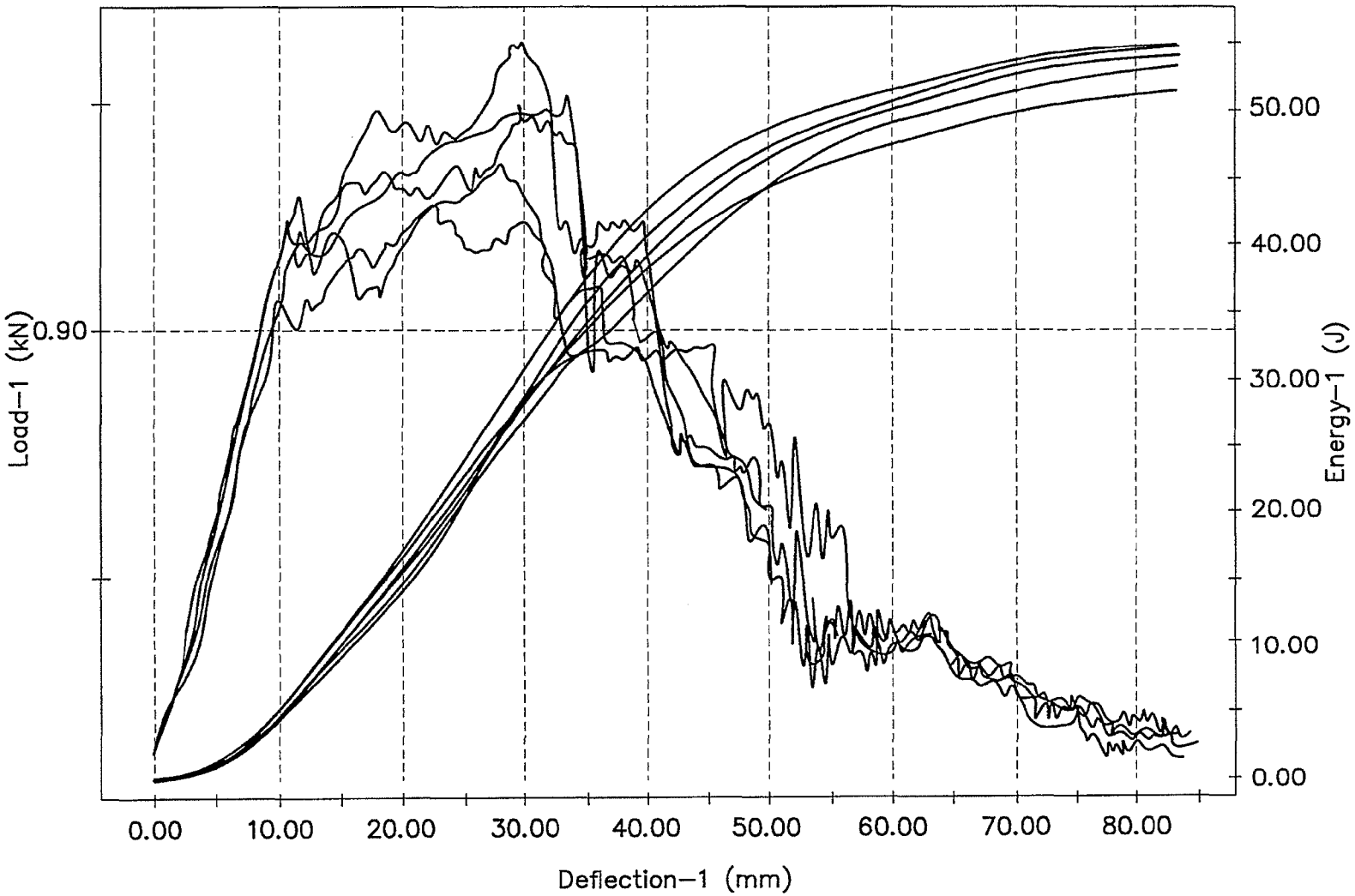
FIG. 4 is a graph showing the results of Example 3.

FIG. 4 shows the measured load relative to the deflection during the DYNATUP impact test for each of the five specimens. FIG. 4 shows the relatively high level of resistance to impact, compared to conventional PVC-based membranes presented in Example 2, where the curves show sustained energy after the point of impact.

TABLE 4

| Test No. | Impact Velocity (m/s) | Thickness (mm) | Deflection at Max Load (mm) | Max Load (N) | Energy to Max Load (J) | Total Energy (J) | Time to Max Load (ms) |
|---|---|---|---|---|---|---|---|
| 1 | 3.30 | 38.32 | 33.47 | 1377 | 31.3 | 54.4 | 10.34 |
| 2 | 3.30 | 38.46 | 24.04 | 1245 | 19.69 | 53.25 | 7.33 |
| 3 | 3.30 | 38.9 | 29.26 | 1480 | 29.57 | 54.71 | 9.05 |
| 4 | 3.29 | 38.36 | 29.78 | 1366 | 28.27 | 54.78 | 9.19 |
| 5 | 3.29 | 38.16 | 18.41 | 1230 | 15.04 | 51.33 | 5.61 |
| Average | 3.30 | 38.44 | 26.99 | 1339 | 24.77 | 53.69 | 8.30 |

The results in Table 4 show that the loft-modified membrane had an average deflection at peak load of about 27.0 mm, an average peak load of about 1,340 Newtons, an average energy at peak load of about 24.8 Joules, and an average total energy of about 53.7 Joules.

The 0.5 inch tup did not penetrate the upper surface of the membrane. The loft-modified membrane seemed to have absorbed and transferred the impact energy to the polyisocyanurate foam, thus preventing puncture of the membrane but leading to damage of the foam.

Example 4

Figure 5:
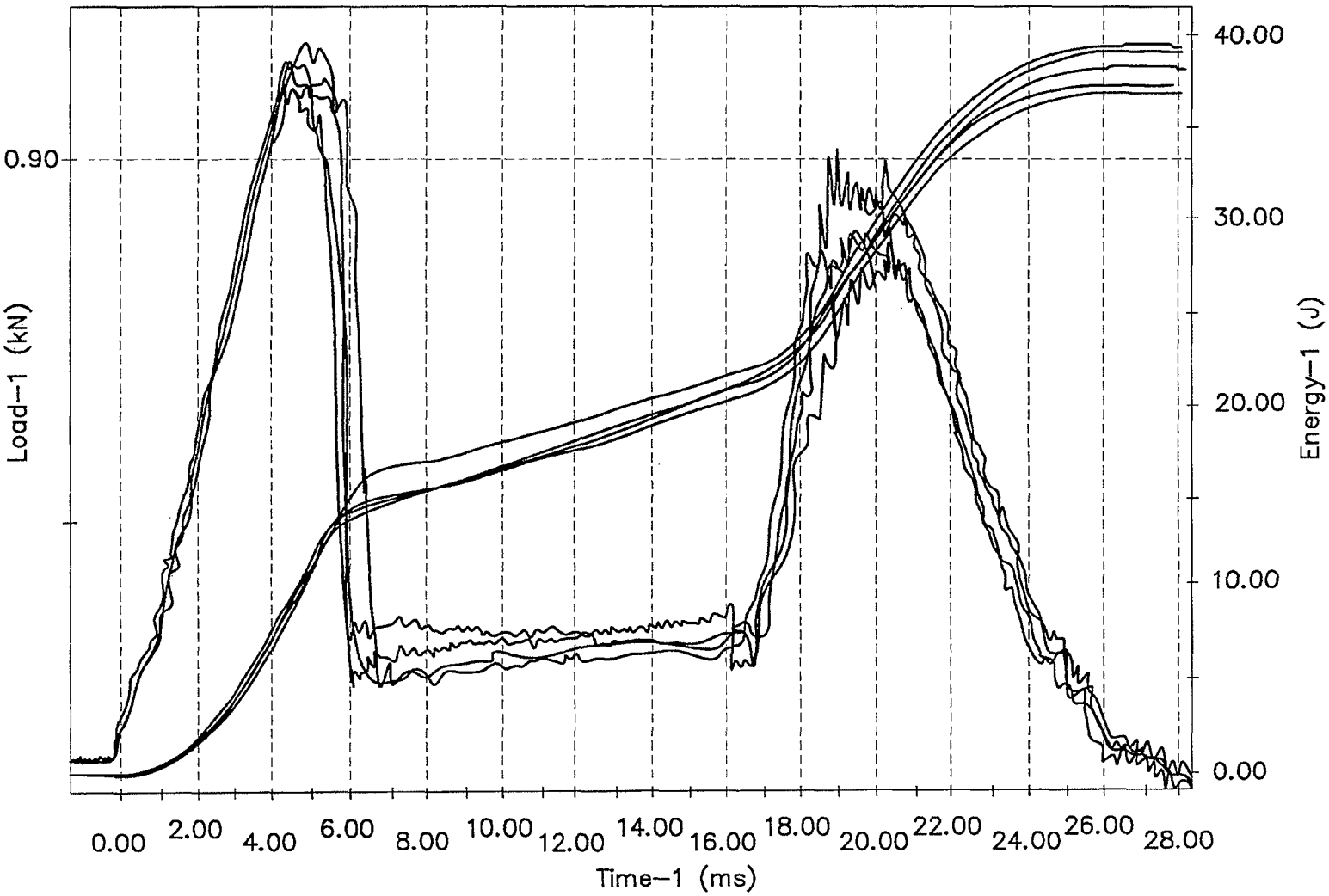
FIG. 5 is a graph showing the results of Example 4.

A conventional single ply membrane with a TPO-based membrane was prepared by laminating TPO on a scrim having an average thickness of 50.3 mm. Impact testing was performed on five specimens and the results are summarized in presented in FIG. 5 and Table 5. In the graph that shows the measured load relative to the deflection during the DYNATUP impact test for each of the five specimens FIG. 5, the specimens show a relatively low level of impact resistance, where the curve flattens after the point of impact. It is believed that the secondary peaks were caused by load cell bottoming.

TABLE 5

| Test No. | Impact Velocity (m/s) | Thickness (mm) | Deflection at Max Load (mm) | Max Load (N) | Energy to Max Load (J) | Total Energy (J) | Time to Max Load (ms) |
|---|---|---|---|---|---|---|---|
| 1 | 3.26 | 50.36 | 15.33 | 1255 | 10.21 | 39.4 | 4.69 |
| 2 | 3.26 | 50.6 | 17.68 | 1219 | 12.59 | 36.88 | 5.43 |
| 3 | 3.26 | 49.62 | 15.27 | 1238 | 9.87 | 37.23 | 4.67 |
| 4 | 3.27 | 50.44 | 16.38 | 1282 | 10.62 | 38.3 | 5 |
| 5 | 3.28 | 50.52 | 15.42 | 1202 | 9.49 | 39.15 | 4.69 |
| Average | 3.27 | 50.31 | 16.02 | 1239 | 10.56 | 38.19 | 4.9 |

The results in Table 5 show an average deflection at peak load of about 16.0 mm, an average peak load of about 1,240 Newtons, an average energy at peak load of about 10.6 Joules, and an average total energy of about 38.2 Joules.

Example 5

Figure 6:
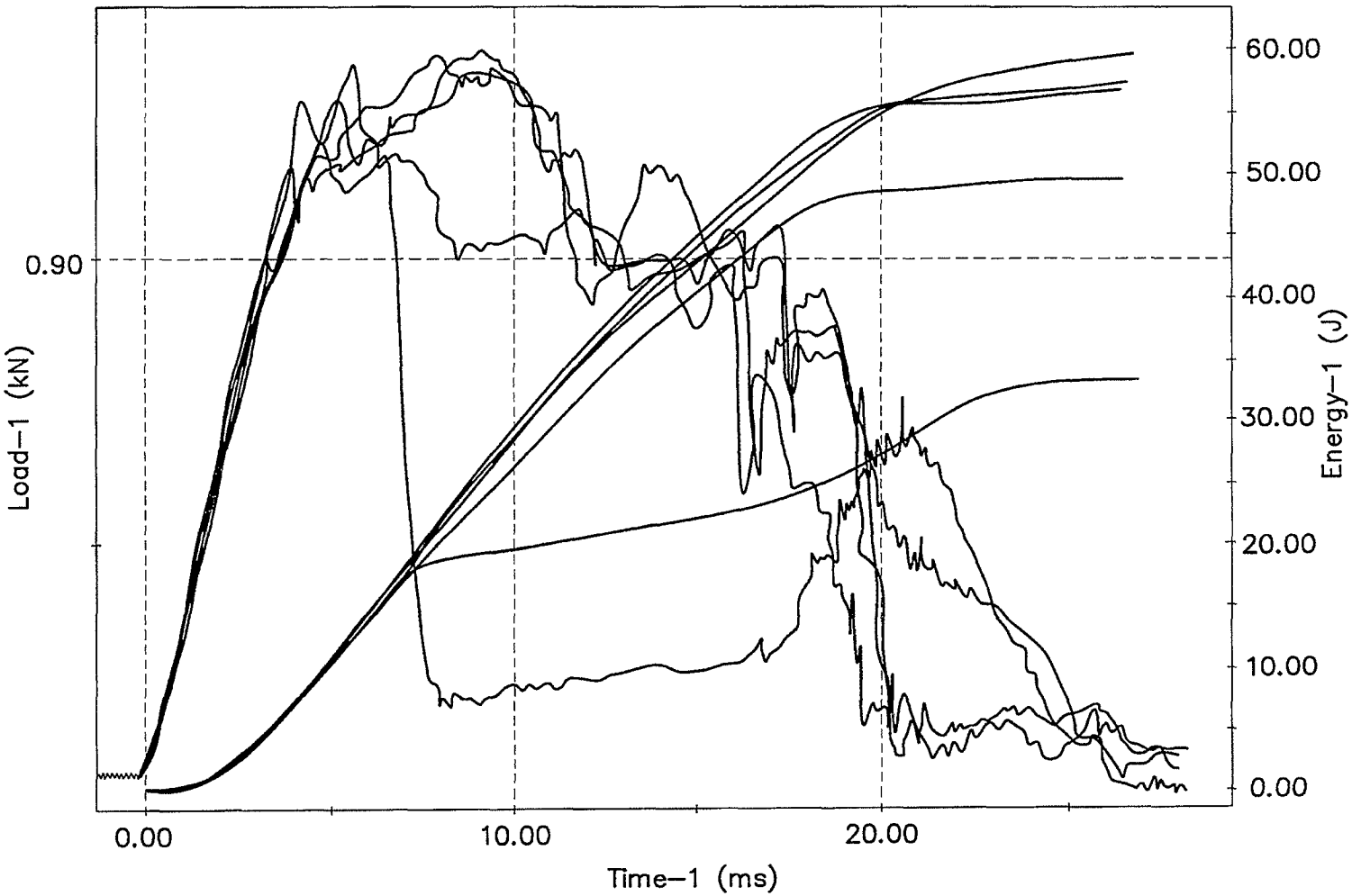
FIG. 6 is a graph showing the results of Example 5.

A TPO-based membrane (REVOLUTION ROOFING MEMBRANE) was prepared as in the PVC-based membrane by laminating TPO on a scrim having an average thickness of 50.1 mm. Impact testing was performed on five specimens and the results are presented in Table 6. FIG. 6 is a graph showing the measured load relative to the deflection during the DYNATUP impact test for each of the five specimens. FIG. 6 shows the relatively high level of resistance to impact, where the energy is sustained after the point of impact.

The 0.5 inch tup did not penetrate the upper surface of the membrane. The loft-modified membrane seemed to have absorbed and transferred the impact energy to the polyisocyanurate foam, thus preventing puncture of the membrane but leading to damage of the foam.

TABLE 6

| Test No. | Impact Velocity (m/s) | Thickness (mm) | Deflection at Max Load (mm) | Max Load (N) | Energy to Max Load (J) | Total Energy (J) | Time to Max Load (ms) |
|---|---|---|---|---|---|---|---|
| 1 | 3.28 | 49.17 | 21.16 | 1088.64 | 15.13 | 49.65 | 6.47 |
| 2 | 3.27 | 50.72 | 25.80 | 1263.60 | 21.51 | 56.95 | 7.98 |
| 3 | 3.25 | 50.54 | 29.39 | 1275.13 | 25.77 | 57.19 | 9.17 |
| 4 | 3.25 | 49.97 | 18.43 | 1248.05 | 13.09 | 33.43 | 5.68 |
| 5 | 3.26 | 50.29 | 29.02 | 1235.83 | 24.85 | 59.70 | 9.04 |
| Average | 3.26 | 50.14 | 24.76 | 1222.25 | 20.07 | 51.38 | 7.67 |

The results in Table 6 show that the loft-based TPO membrane had an average deflection at peak load of 24.8 mm, an average peak load of 1,220 Newtons, an average energy at peak load of 20.1 Joules, and an average total energy of 51.4 Joules.

Comparing the results of Example 2 to the results of Example 3 show that increased impact resistance is apparent with loft-modified membranes.

Likewise, comparing the results of Example 4 to the results of Example 5, increased impact resistance of the loft comprising membranes is apparent. This differential is also reflected in FIG. 6.

Thus, the loft-modified membrane of the present disclosure has improved mechanical properties compared to conventional membranes.

These examples, figures, and tables show that a single ply membrane using a reinforced needle-punched fleece substrate coated on both sides with waterproofing/protective compounds increases the amount of impact energy that the membrane can absorb. This in turn increases its overall impact and hail resistance. In addition, there may be a resultant higher adhesion of the polymer compound to the substrate, thus making it more resistant to wind uplift forces, especially on roofs.

Having now described some illustrative embodiments of the disclosure, it should be apparent to those skilled in the art that the foregoing is merely illustrative and not limiting, having been presented by way of example only. Numerous modifications and other embodiments are within the scope of one of ordinary skill in the art and are contemplated as falling within the scope of the disclosure. In particular, although many of the examples presented herein involve specific combinations of method acts or system elements, it should be understood that those acts and those elements may be combined in other ways to accomplish the same objectives.

Those skilled in the art should appreciate that the parameters and configurations described herein are exemplary and that actual parameters and/or configurations will depend on the specific application in which the systems and techniques of the disclosure are used. Those skilled in the art should also recognize or be able to ascertain, using no more than routine experimentation, equivalents to the specific embodiments of the disclosure. It is therefore to be understood that the embodiments described herein are presented by way of example only and that, within the scope of the appended claims and equivalents thereto; the disclosure may be practiced otherwise than as specifically described.

Moreover, it should also be appreciated that the disclosure is directed to each feature, system, subsystem, or technique described herein and any combination of two or more features, systems, subsystems, or techniques described herein and any combination of two or more features, systems, subsystems, and/or methods, if such features, systems, subsystems, and techniques are not mutually inconsistent, is considered to be within the scope of the disclosure as embodied in the claims. Further, acts, elements, and features discussed only in connection with one embodiment are not intended to be excluded from a similar role in other embodiments.

As used herein, the term "plurality" refers to two or more items or components. The terms "comprising," "including," "carrying," "having," "containing," and "involving," whether in the written description or the claims and the like, are open-ended terms, i.e., to mean "including but not limited to." Thus, the use of such terms is meant to encompass the items listed thereafter, and equivalents thereof, as well as additional items. Only the transitional phrases "consisting of" and "consisting essentially of," are closed or semi-closed transitional phrases, respectively, with respect to the claims. Use of ordinal terms such as "first," "second," "third," and the like in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

What is claimed is:

1. A single ply membrane comprising: a loft layer having a fleece layer and a reinforcing layer, the fleece layer being needle-punched to the reinforcing layer; a first polymeric layer bonded to the fleece layer; and a second polymeric layer bonded to the reinforcing layer, wherein at least one of the first polymeric layer and second polymeric layer comprises between about 40 wt % and 60 wt % of polyvinyl chloride, a plasticizer, and titanium dioxide, the single ply membrane having a thickness in a range of about 38 mm to about 50 mm.

2. The single ply membrane of claim 1, wherein the fleece comprises synthetic fibers.

3. The single ply membrane of claim 1, wherein the first polymeric layer comprises a thermoplastic material selected from the group consisting of polyolefin, polyvinyl chloride, polypropylene, polyethylene, rubber.

4. The single ply membrane of claim 1, wherein the first and second polymeric layers comprises polyvinyl chloride.

5. A method of fabricating a single ply membrane comprising:

providing a loft layer having a fleece layer and a reinforcing layer; the fleece layer being needle-punched to the reinforcing layer;

securing a first polymeric layer to the fleece layer; and securing a second polymeric layer to the reinforcing layer, wherein at least one of the first polymeric layer and second polymeric layer comprises between about 40 wt % and 60 wt % of polyvinyl chloride, a plasticizer, and titanium dioxide, the single ply membrane having a thickness in the range of about 38 mm to about 50 mm.

6. A method of facilitating protecting a structure comprising:

providing a single ply membrane having a loft layer having a fleece layer and a reinforcing layer, a first polymeric layersecured to the fleece layer, and a second polymeric layer secured to the reinforcing layer, the fleece layer being needle-punched to the reinforcing layer;

wherein at least one of the first polymeric layer and second polymeric layer comprises between about 40 wt % and 60 wt % of polyvinyl chloride, a plasticizer, and titanium dioxide, the membrane having a thickness in range of about 38 mm to about 50 mm; and installing the single ply membrane on at least a portion of a roof of the structure.

7. The single ply membrane of claim 1, wherein the first polymeric layer comprises polyvinyl chloride, a plasticizer, and titanium dioxide, the second polymeric layer comprises polyvinyl chloride and a plasticizer.

8. The single ply membrane of claim 7, wherein the reinforcing layer comprises a polyester scrim and the fleece layer comprises polyester fibers.

9. The method of claim 5, wherein at least one of the first polymeric layer and the second polymeric layer comprises a polyolefin.

* * * * *